US006308722B1

(12) United States Patent
Christie

(10) Patent No.: US 6,308,722 B1
(45) Date of Patent: Oct. 30, 2001

(54) UMBRELLA MOUNTABLE ON A BACKPACK

(76) Inventor: Joseph L. Christie, 1442 Pennygent La., Channelview, TX (US) 77530

( * ) Notice: Subject to any disclaimer, the term of this patent is extended or adjusted under 35 U.S.C. 154(b) by 0 days.

(21) Appl. No.: 09/651,967

(22) Filed: Aug. 31, 2000

(51) Int. Cl.[7] ..... A45B 3/00; A45B 11/02

(52) U.S. Cl. ..... 135/16; 224/186; 224/576; 224/680

(58) Field of Search ..... 135/15.1, 16; D3/5, D3/10; 224/242, 251, 186, 576, 660, 676, 680

(56) References Cited

U.S. PATENT DOCUMENTS

| | | | | |
|---|---|---|---|---|
| D. 330,455 | | 10/1992 | Massie . | |
| 988,485 | * | 4/1911 | Mitchell | 224/186 |
| 1,755,209 | * | 4/1930 | Danner | 224/188 |
| 4,188,965 | | 2/1980 | Morman . | |
| 5,263,837 | * | 11/1993 | Dompe | 224/190 |
| 5,699,818 | * | 12/1997 | Carpenter, Jr. | 135/16 |
| 5,878,761 | * | 3/1999 | Vadher | 135/16 |
| 5,887,771 | * | 3/1999 | Perry | 224/190 |
| 6,024,464 | * | 2/2000 | DeVera | 224/190 |
| 6,053,385 | * | 4/2000 | Ward et al. | 224/576 |
| 6,076,539 | * | 6/2000 | Richardson | 135/20.1 |

* cited by examiner

*Primary Examiner*—Michael Safavi
(74) *Attorney, Agent, or Firm*—Norman B. Rainer

(57) ABSTRACT

An umbrella and backpack combination includes an umbrella having a collapsible canopy and a straight center shaft extending to a lower extremity having a spring-biased locking feature. A backpack having a storage compartment bounded in part by forward and rearward fabric surfaces confines an umbrella holding structure having a vertically disposed tubular receiver and horizontally disposed stabilizing bars attached to the receiver. The lower extremity of the shaft enters the receiver and releasibly locks therewith.

11 Claims, 2 Drawing Sheets

UMBRELLA MOUNTABLE ON A BACKPACK

BACKGROUND OF THE INVENTION

1. Field of the Invention

This invention relates to an umbrella, and more particularly concerns an umbrella which can be supported by a backpack worn by the user.

2. Description of the Prior Art

Umbrellas intended for hand-held use are generally comprised of a collapsible canopy, an elongated shaft that is usually telescopically extendable, and a holding handle disposed at the lower extremity of the shaft. Such umbrellas have long been used by persons desiring to shield themselves from the sun and rain. It is well established that, from a health standpoint, it is desirable to minimize exposure to direct sunlight.

Conventionally, umbrellas are hand carried by the person using the umbrella. Carrying an umbrella, however does not allow the free use of a person's hands to carry packages or the like, or perform other functions. It is therefore desirable to provide an improved umbrella that will allow a person using the umbrella to use their hands without being encumbered by the umbrella.

While umbrellas have heretofore been strapped to the back of a person, they are difficult to attach and the harnesses are clumsy. Further, such harnesses must be detached if the umbrella is to be hand-held, as is conventional. It is therefore desirable to provide an umbrella which can be worn, if desired, but which includes structure which allows the umbrella to be worn or hand-held, as desired, while still being convenient to use and conveniently stored.

Examples of such back-mounted umbrellas are disclosed in U.S. Pat. Nos. D330,455; D345,856; D361,654; 3,892,251 and 4,188,965. In general, such back-mounted umbrellas involve a harness which either secures an umbrella of usual construction having a bottom handle, or secures a specially constructed umbrella having a straight shaft that removably inserts into a holding structure associated with the harness.

A common shortcoming of prior back-mounted umbrellas is that the umbrella tends to rotate within the holding structure, particularly in strong winds. Also, tilting movements in both the path of the person's walking movement and in the lateral or transverse direction are difficult to control. When a specialized harness is employed, it is difficult to emplace and is restrictive, and serves no other useful purpose.

Backpack carrying units are in commonplace use by hikers, campers and school students. The usual backpack is comprised of a storage compartment adapted to be worn on the back and secured by paired shoulder straps and a waist belt.

It is accordingly an object of the present invention to provide an umbrella and backpack combination wherein the backpack provides support for the umbrella.

It is a further object of this invention to provide the combination of the foregoing object wherein the umbrella is easily attached to and removed from the backpack.

It is another object of the present invention to provide the combination of the aforesaid nature wherein the umbrella, in its deployed, open state is stabilized with respect to rotative and tilting movements.

It is yet another object of this invention to provide the combination of the aforesaid nature wherein said backpack contains means for securing said umbrella in its collapsed, storage state.

It is a still further object of the present invention to provide the combination of the aforesaid nature wherein the separate functionality of umbrella and backpack remains unimpaired.

These objects and other objects and advantages of the invention will be apparent from the following description.

SUMMARY OF THE INVENTION

The above and other beneficial objects and advantages are accomplished in accordance with the present invention by an umbrella and backpack combination comprising:

a) an umbrella comprising a collapsible canopy and a straight center shaft interactive with said canopy and extending to a lower terminal extremity having spring biased locking means, b) a backpack having a storage compartment bounded in part by forward and rearward surfaces, and paired shoulder straps and a waist strap associated with said forward surface, and c) umbrella holding means associated with the forward surface of said backpack and comprising a vertically disposed tubular receiver and horizontally disposed stabilizing means attached to said receiver.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
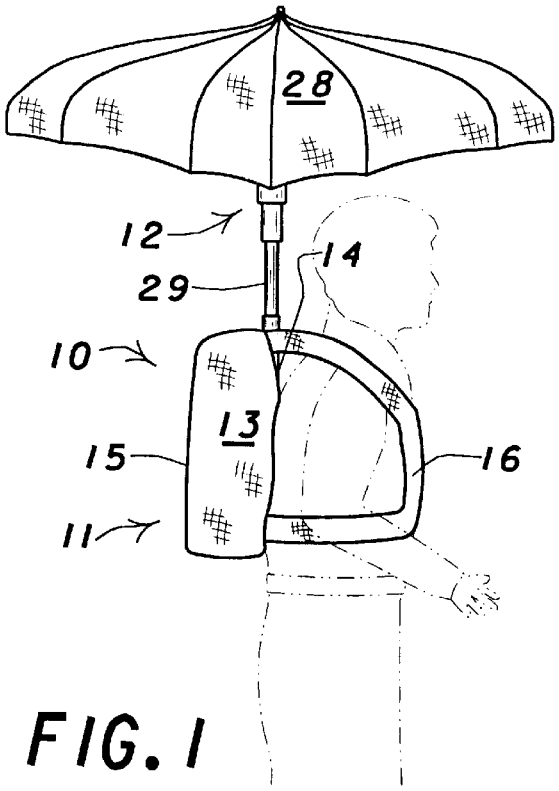
FIG. 1 is a side view of an embodiment of the umbrella and backpack combination of the present invention showing the umbrella in its functionally deployed state.
Figure 2:
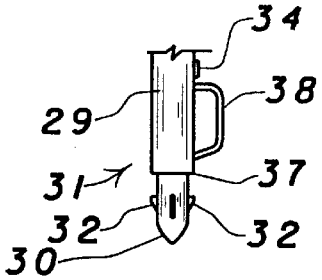
FIG. 2 is a fragmentary exploded front view of the umbrella holding component of the embodiment of FIG. 1.
Figure 2:
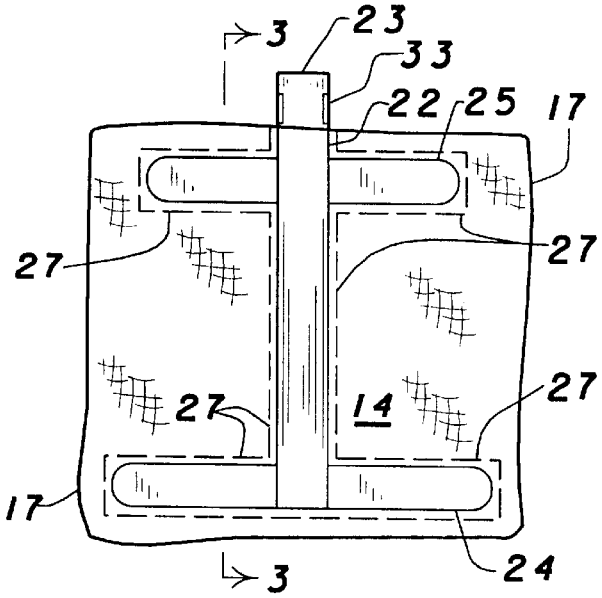
Figure 3:
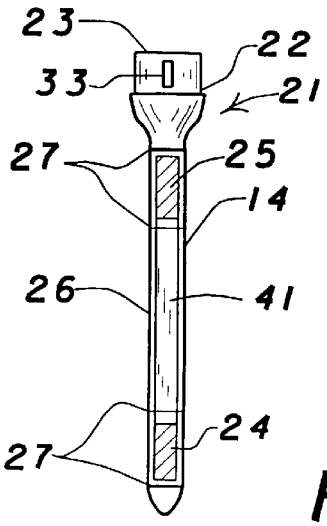
FIG. 3 is a vertical sectional view taken in the direction of the arrows upon the line 3—3 of FIG. 2.
Figure 5:
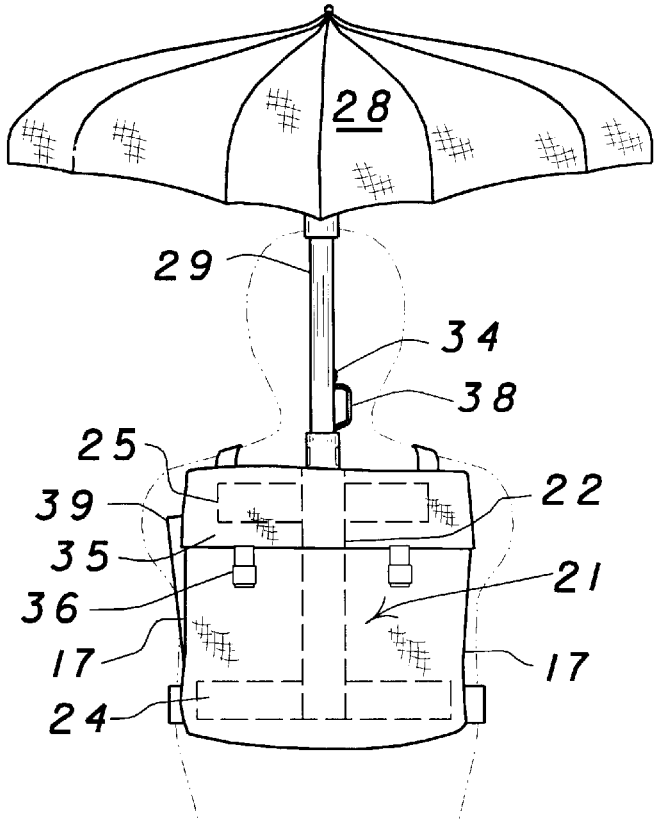
FIG. 5 is a rear view of the embodiment of FIG. 1.
Figure 4:
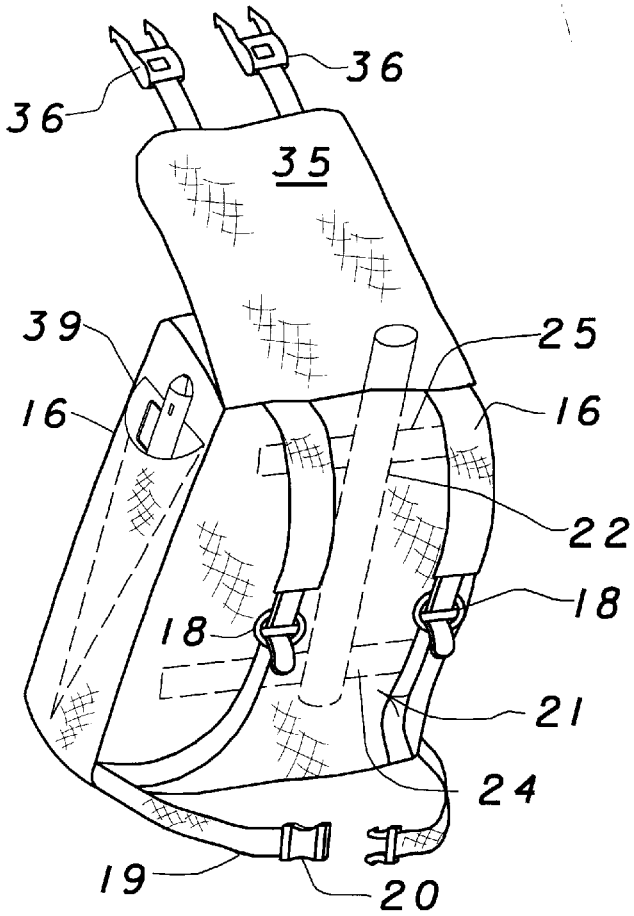
FIG. 4 is a perspective front view of the umbrella and backpack combination of FIG. 1, showing the umbrella in its storage state.

Referring now to FIGS. 1–5, an embodiment of the umbrella and backpack combination 10 of the present invention is shown comprised of backpack 11 and umbrella 12.

Backpack 11 is of conventional construction, comprised of a storage compartment 13 fabricated of sturdy fabric such as rip-stop nylon, and bounded in part by forward and rearward surfaces 14 and 15, respectively. Paired vertically oriented shoulder straps 16, fabricated of heavy duty fabric belting, are attached by sewing to forward surface 14 adjacent the opposite sides 17 of compartment 13. Said shoulder straps are usually equipped with adjusting buckles 18. A horizontally oriented waist strap 19 is also associated with forward surface 14, and equipped with adjustment buckle 20. A closure flap 35 is attached to the upper extremity of forward surface 14, and extends onto rearward surface 15 for engagement therewith by means of snap connectors 36.

Umbrella holding means in the form of anchoring structure 21 are associated with forward surface 14. Anchoring structure 21 is comprised of a vertically disposed tubular receiver 22 having an open upper extremity 23. The lower portion 41 of said receiver is preferably flattened so as to minimize space occupied within the backpack. At least one horizontally disposed stabilizing means in the form of elongated bar 24 is attached to receiver 22. In the illustrated preferred embodiment,second stabilizing means in the form of bar 25 is disposed upon receiver 22 above bar 24. Said stabilizing bars may be in two halves extending from opposite sides of flattened receiver 22 in coplanar relationship therewith. Anchoring structure 21 is sandwiched between forward surface 14 and a fabric facing panel 26. Lines of sewing 27 interengage facing panel 26 and forward surface 14 along the entire perimeter outline of said anchoring structure, thereby securing said anchoring structure in proper orientation on the backpack. Other means may, however be employed to secure said anchoring structure to said backpack. Anchoring structure 21 may be fabricated of lightweight metal such as aluminum, or may be fabricated of plastic, in which case it may be a monolithic structure produced by way of a molding operation.

Umbrella 12 is comprised of collapsible canopy 28 and a straight center shaft 29 interactive in conventional manner with said canopy. Shaft 29, preferably of telescopically extendable tubular construction, extends to a lower terminal extremity 30 equipped with spring biased locking means 31. The exemplified embodiment of said locking means is comprised of diametrically opposed tabs 32 which are outwardly urged from shaft 29 by spring means within said shaft. Tabs 32 are configured and positioned so as to engage matching slots 33 in receiver 22. A push-button control 34 on shaft 29 causes retraction of said tabs with attendant release from receiver 22. A shoulder 37 on shaft 29 is adapted to seat in abutment with the upper extremity 23 of receiver 22. The umbrella, in its collapsed storage state may have a length of between about 10 and 14 inches.

When shaft 29 is inserted into receiver 22 and tabs 32 are functionally deployed in slots 33, the umbrella is sufficiently secure so as to resist rotative movement about the shaft axis, and to resist tilting movement in any direction away from verticality. A hand grip 38 is preferably associated with shaft 29 adjacent said terminal extremity 30. Said hand grip facilitates the use of the umbrella in a conventional hand-held manner detached from the backpack. Holding means, which may be in the form of compartment 39 are associated with the backpack for storage of the umbrella in its collapsed state.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. An umbrella and backpack combination comprising:

a) an umbrella comprising a collapsible canopy and a straight center shaft interactive with said canopy and extending to a lower terminal extremity having spring biased locking means, b) a backpack having a storage compartment bounded in part by forward and rearward fabric surfaces, and having paired shoulder straps and a waist strap associated with said forward surface, and c) umbrella holding means associated with the forward surface of said backpack and comprising a vertically disposed tubular receiver having an open upper extremity, and horizontally disposed stabilizing means attached to said receiver.

2. The combination of claim 1 wherein said tubular receiver has a lower portion which is flattened so as to minimize space occupied.

3. The combination of claim 2 wherein said stabilizing means is a first elongated bar.

4. The combination of claim 3 having a second elongated bar attached to said receiver above said first bar.

5. The combination of claim 4 wherein said first and second bars each exist as two halves extending from opposite sides of the lower portion of said receiver in coplanar relationship.

6. The combination of claim 5 wherein said holding means is sandwiched between said forward surface and a parallel fabric facing panel.

7. The combination of claim 6 wherein lines of sewing interengage said forward surface and facing panel along the perimeter of said holding means.

8. The combination of claim 7 wherein said locking means is comprised of diametrically opposed tabs outwardly urged from said shaft by spring means within said shaft.

9. The combination of claim 8 wherein said receiver has slots which receive said tabs.

10. The combination of claim 1 wherein said umbrella, in its collapsed storage state has a length between 10 and 14 inches.

11. The combination of claim 10 wherein said backpack has a compartment for the storage of said umbrella in its collapsed state.

* * * * *